US010522276B2

(12) United States Patent
Miwa et al.

(10) Patent No.: US 10,522,276 B2
(45) Date of Patent: Dec. 31, 2019

(54) R-T-B BASED SINTERED MAGNET

(71) Applicant: TDK CORPORATION, Tokyo (JP)

(72) Inventors: Masashi Miwa, Tokyo (JP); Takurou Iwasa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/015,800

(22) Filed: Feb. 4, 2016

(65) Prior Publication Data

US 2016/0225502 A1 Aug. 4, 2016

(30) Foreign Application Priority Data

Feb. 4, 2015 (JP) ..... 2015-020274

(51) Int. Cl.
*B22F 3/10* (2006.01)
*H01F 7/02* (2006.01)
*H01F 1/057* (2006.01)

(52) U.S. Cl.
CPC ..... *H01F 1/0577* (2013.01)

(58) Field of Classification Search
None
See application file for complete search history.

(56) References Cited

U.S. PATENT DOCUMENTS 9,028,624 B2 5/2015 Sagawa et al.
2011/0025440 A1* 2/2011 Kuniyoshi ..... H01F 1/0573 335/302
2011/0279205 A1* 11/2011 Fukui ..... C22C 28/00 335/302
2013/0092868 A1* 4/2013 Nakajima ..... C22C 38/005 252/62.51 R
2014/0105779 A1* 4/2014 Nakamura ..... H01F 1/0572 419/31
2014/0132377 A1* 5/2014 Nakajima ..... B22F 3/24 335/302
2014/0327503 A1 11/2014 Sagawa et al.
2015/0235750 A1* 8/2015 Miwa ..... H01F 7/021 335/302
2016/0042848 A1* 2/2016 Kuniyoshi ..... C22C 38/002 75/246
2016/0163434 A1* 6/2016 Kanada ..... C22C 38/00 310/156.08

(Continued)

FOREIGN PATENT DOCUMENTS

JP H02-60105 A 2/1990
JP H08-288112 A 11/1996

(Continued)

*Primary Examiner* — Xiaowei Su
(74) *Attorney, Agent, or Firm* — Oliff PLC

(57) ABSTRACT

An R-T-B based sintered magnet has a high coercivity even if the carbon content becomes high accompanying the micronization of the finely pulverized particles of the raw material. The R-T-B based sintered magnet includes an R-T-B based compound as main phase grains, wherein, the R-T-B based sintered magnet contains 0.1 mass % to 0.3 mass % of C, and an R—Ga—C concentrated part exists in the grain boundary formed between or among two or more adjacent main phase grains, and the concentrations of R, Ga and C in the R—Ga—C concentrated part are higher than those in the main phase grains respectively.

13 Claims, 2 Drawing Sheets

(56) References Cited

U.S. PATENT DOCUMENTS

| | | | | |
|---|---|---|---|---|
| 2016/0163435 | A1* | 6/2016 | Miwa | H01F 1/0577<br>335/302 |
| 2016/0180993 | A1* | 6/2016 | Kanada | C22C 38/00<br>252/62.55 |
| 2016/0189838 | A1* | 6/2016 | Nishiuchi | C22C 33/02<br>148/302 |

FOREIGN PATENT DOCUMENTS

| | | | | |
|---|---|---|---|---|
| JP | 2005-286174 | A | 10/2005 | |
| JP | WO 2012002060 | A1 * | 1/2012 | C22C 38/005 |
| JP | WO 2013122255 | A1 * | 8/2013 | B22F 1/0007 |
| JP | 5400255 | B1 | 1/2014 | |
| WO | 2013/100008 | A1 | 7/2013 | |

* cited by examiner

R-T-B BASED SINTERED MAGNET

The present invention relates to an R-T-B based sintered magnet having a rare earth element (R), one or more iron family elements (T) with Fe or the combination of Fe and Co as the necessity, and Boron (B) as the main components.

BACKGROUND

The R-T-B based sintered magnet has excellent magnetic properties and thus is used in the voice coil motor (VCM) in a hard-disc drive, various motors such as the motor provided in a hybrid electric vehicle, household electrical appliances or the like. When an R-T-B based sintered magnet is used in a motor or the like, an excellent heat resistance and a high coercivity are required to adjust itself to the working condition at a higher temperature.

As a means to increase the coercivity (HcJ) of the R-T-B based sintered magnet, the heavy rare earth element such as Dy or Tb is conventionally used to substitute part of the rare earth element R mainly employing the light rare earth element such as Nd or Pr so as to improve the magnetocrystalline anisotropy of the $R_2T_{14}B$ phase. Up to now, it is hard to manufacture a magnet whose coercivity is good enough for a motor or the like if no heavy rare earth element is used.

However, Dy or Tb has fewer resources compared to Nd or Pr and thus is more expensive. In recent years, the supply of Dy or Tb is rather unstable due to the increasing demand for the R-T-B based sintered magnets with a high coercivity which use these elements in a large quantity. Thus, a coercivity required in an motor application is demanded even if a composition is employed where the use of Dy or Tb is substantially declined.

Usually, the crystal grains in the R-T-B based sintered magnet are micronized so as to increase the coercivity. For example, in the following Patent Document 1, it has shown that the coercivity is improved by making the average grain size of the main phase grains to be 4.5 μm or smaller in the NdFeB based sintered magnet, decreasing the carbon content to 1000 ppm or less in the whole NdFeB based sintered magnet and also making the ratio of the total volume occupied by the carbon-rich phases in the triple junctions to that occupied by the rare earth-rich phases to be 50% or less in the NdFeB based sintered magnet.

In order to micronize the crystal grains in the R-T-B based sintered magnet, the particle size of the finely pulverized particles functioning as the raw material needs to be reduced. However, if the particle size of the finely pulverized particles is reduced, the orientation of the crystals by an applied external magnetic field tends to be more difficult in a pressing step. Thus, some countermeasures may be taken sometimes. For example, the amount of a lubricant to be added in the finely pulverized particles is increased. Alternatively, the finely pulverized particles are mixed with an organic solvent to form a slurry followed by a wet pressing step. However, a problem rises in either case that the content of carbon contained in the R-T-B based sintered magnet obtained after sintering increases and the coercivity decreases. Especially, the smaller the particle size is, the larger the specific surface area is in the pulverized particles. In this way, the carbon content tends to increase so that a technical problem rises that the effect of micronization on the coercivity improvement will not be sufficiently produced.

In Patent Document 1, it has been shown that without the heating for dehydrogenation in the hydrogen storage pulverization, the hydrogen based compound will remain in the particles of alloy powder. In addition, with hydrogen generated therein, the carbon content can be declined in the sintered magnet. However, if a large quantity of hydrogen remains in the particles of alloy powder, a technical problem is there that the volume change with the hydrogen emission during the sintering process becomes larger and cracks are likely to occur in the sintered magnet.

In Patent Document 2, it is described that the coercivity decrease can be inhibited by converting the carbon contained in the R—Fe—B based magnet alloy to carbides with any one or two or more kinds of elements from the group consisting of Cr, Mo, Nb, Ta, Ti, V, W and Zr and then precipitating the carbides in the magnet alloy. However, technical problems are there that the carbides having nothing to do with the magnetic properties need to be precipitated in a large quantity and the residual magnetic flux density decreases in the obtained magnet.

PATENT DOCUMENTS

Patent document 1: JP-5400255
Patent document 2: JP-A-H2-60105

SUMMARY

The present invention has been made by considering the above conditions, and the object of the present invention is to provide an R-T-B based sintered magnet which has a high coercivity even if the carbon content becomes high accompanying the micronization of the finely pulverized particles of the raw material.

In order to accomplish the goal mentioned above, the R-T-B based sintered magnet of the present invention is characterized in that it contains an R-T-B based compound as the main phase grains, wherein the R-T-B based sintered magnet mentioned above contains 0.1 mass % to 0.3 mass % of C, and an R—Ga—C concentrated part exists in the grain boundary formed between or among two or more adjacent main phase grains, and the concentrations of R, Ga and C in the R—Ga—C concentrated part are higher than those in the main phase grains respectively.

With the R-T-B based sintered magnets of the present invention mentioned above, a high coercivity can be obtained even if the particle size of the finely pulverized particles is reduced and the content of carbon contained in the sintered magnet is as high as 0.1 mass % to 0.3 mass %. In the conventional method for manufacturing the R-T-B based sintered magnet, most of the carbon reacts with the rare earth-rich phases (referred to as R-rich phases) present in the grain boundary to form carbides. The R-T-B based sintered magnet is a magnet obtained by liquid phase sintering, in which sintering is progressed by turning the R-rich phases into a liquid phase, and the carbides do not turn into the liquid phase during the sintering process. Thus, the formation of carbides reduces the amount of the R-rich phases for that and results in the decrease of the coercivity. In contrast, in the R-T-B based sintered magnet of the present invention, the R—Ga—C concentrated part formed in the grain boundary is a phase containing carbon which helps to generate the liquid phase during sintering. Therefore, even the carbon content is high, the liquid phase will be in a sufficient amount during the sintering process and a high coercivity will be provided.

In addition, in the present invention, the R—Ga—C concentrated part further contains Cu, and the concentration of Cu in the R—Ga—C concentrated part is preferably higher than that in the main phase grains. As the R—Ga—C concentrated part contains Cu, the wettability between the R—Ga—C concentrated part and the main phase grains can be improved, and a thick two-grain boundary part tends to be formed. As such, the coercivity will be readily increased.

In the present invention, the R—Ga—C concentrated part further contains Co. It is more preferable that the concentration of Co in the R—Ga—C concentrated part is higher than that in the main phase grains. The coercivity tends to further increase by containing Co in the R—Ga—C concentrated part.

With the present invention, an R-T-B based sintered magnet can be provided which has a high coercivity even if the carbon content becomes high accompanying the micronization of the finely pulverized particles of the raw material.

DETAILED DESCRIPTION OF EMBODIMENTS

Figure 1:
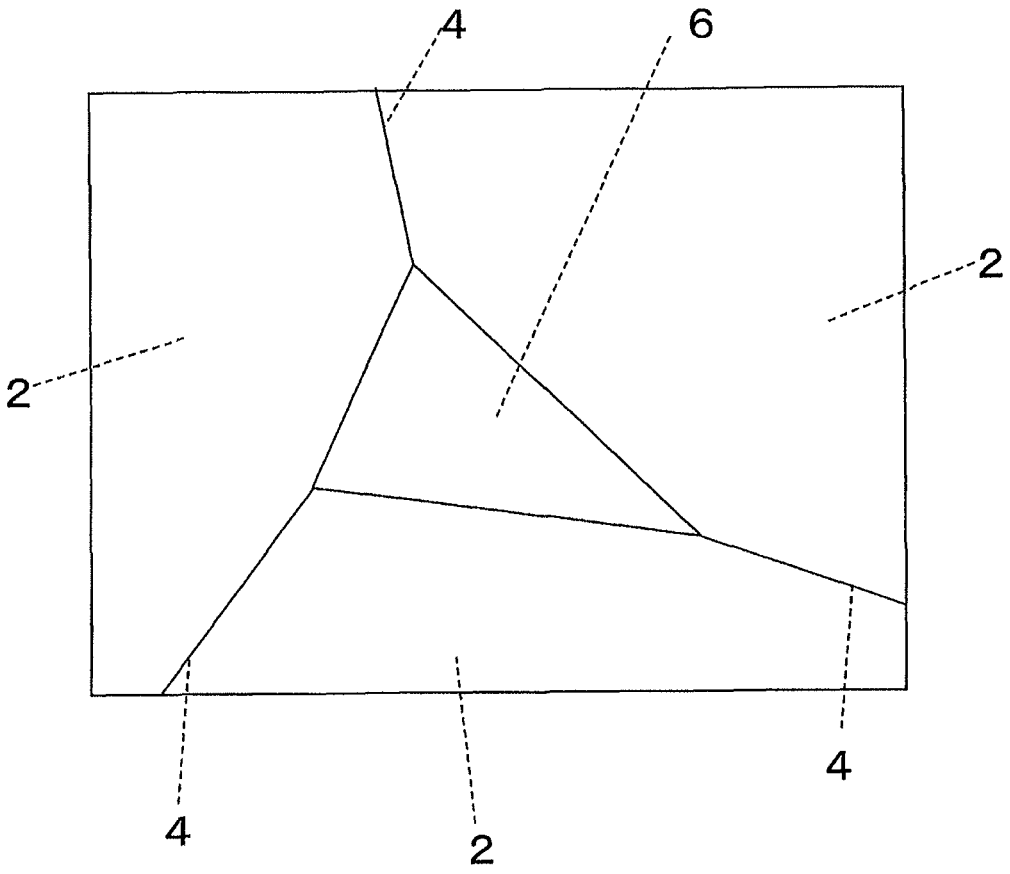
FIG. 1 is a figure schematically showing a back-scattered-electron image of the vicinity of a grain boundary surrounded by several main phase grains in the R-T-B based sintered magnet of the present invention.

Hereinafter, the present invention will be described based on the embodiments shown in the drawings.

<R-T-B Based Sintered Magnet>

The embodiments of the R-T-B based sintered magnet in the embodiment of the present invention will be described. As shown in FIG. 1, the R-T-B based sintered magnet in the present embodiment contains main phase grains 2 composed of an R-T-B based compound, wherein an R—Ga—C concentrated part exists in the grain boundary formed between or among two or more adjacent main phase grains, and the concentrations of R, Ga and C in the R—Ga—C concentrated part are higher than those in the main phase grains respectively.

The grain boundary contains two-grain boundary part 4 formed between two adjacent grains and triple junction 6 formed among three or more main phase grains. In addition, the R—Ga—C concentrated part is the part that exists in the grain boundary formed between or among two or more adjacent main phase grains and has the concentrations of R, Ga and C higher than those in the main phase grains respectively. Other components can be contained in the R—Ga—C concentrated part as long as R, Ga and C are contained as the main components.

Preferably, the R—Ga—C concentrated part further contains Cu, and the concentration of Cu in the R—Ga—C concentrated part is higher than that in the main phase grains. When the R—Ga—C concentrated part contains Cu, as described above, the wettability between the R—Ga—C concentrated part and the main phase grains will be improved and a thick two-grain boundary part is likely to be formed. As such, the coercivity will be easily increased.

It is preferable that the R—Ga—C concentrated part further contains Co, and the concentration of Co in the R—Ga—C concentrated part is higher than that in the main phase grains. As the R—Ga—C concentrated part contains Co, the coercivity tends to be increased more easily.

The R-T-B based sintered magnet in the present embodiment is a sintered body formed by using an R-T-B based alloy. The R-T-B based sintered magnet of the present embodiment contains main phase grains composed of an R-T-B based compound and the grain boundaries having more R than the main phase grains.

R represents at least one rare earth element. The rare earth element refers to Sc, Y and lanthanoid elements, which belong to the third group of a long period type periodic table. The lanthanoid element includes, for example, La, Ce, Pr, Nd, Sm, Eu, Gd, Tb, Dy, Ho, Er, Tm, Yb, Lu and the like. The rare earth element is classified as the light rare earth and the heavy rare earth. The heavy rare earth element (hereinafter referred to as RH) refers to Gd, Tb, Dy, Ho, Er, Tm, Yb and Lu while the light rare earth element (hereinafter referred to as RL) refers to the other rare earth elements.

In the present embodiment, T represents one or more iron family elements including Fe or the combination of Fe and Co. T may be Fe alone or a kind of Fe partly substituted by Co. When part of Fe is substituted by Co, the temperature properties can be improved without deteriorating magnetic properties.

In the R-T-B based sintered magnet of the present embodiment, part of B can be substituted with carbon (C). In this case, the manufacture of the magnet becomes easy and the manufacture cost can be decreased. Further, the amount of C to substitute B is substantially an amount having no effect on the magnetic properties.

The R-T-B based sintered magnet of the present embodiment may also contain various well-known additive elements. In particular, at least one element selected from the group consisting of Ti, V, Cu, Cr, Mn, Ni, Zr, Nb, Mo, Hf, Ta, W, Al, Ga, Si, Bi and Sn may be contained.

The main phase grains contained in the R-T-B based sintered magnet of the present embodiment are composed of an R-T-B based compound, and this R-T-B based compound is a kind of compound having its crystal structure composed of the tetragonal $R_2T_{14}B$.

In the present embodiment, the cross-sectional area of each main phase grain in a cross-section inside the R-T-B based sintered magnet that is parallel to the c-axis is calculated by a method such as one involving image processing, and the diameter of a circle having said cross-sectional area (i.e., the equivalent diameter of the circle) is defined as the grain size of the main phase grain in that cross-section. Further, the grain size of the main phase grain (whose cross-sectional area is cumulative 50% of the entire cross-sectional area accumulated from the main phase grain with a small cross-sectional area) is defined as the average grain size of the main phase grains.

The average grain size of the main phase grains that are contained in the sintered magnet of the R-T-B based compound in the present embodiment is preferably 4.0 μm or less. If the average grain size of the main phase grains is larger than 4.0 μm, the coercivity tends to decrease. In addition, it is more preferable that the average grain size of the main phase grains ranges from 1.5 μm to 3.0 μm. With such a range, it is likely to provide a higher coercivity.

The R-T-B based sintered magnet of the present embodiment contains at least the R—Ga—C concentrated part. In addition to the R—Ga—C concentrated part, the R-rich phase having R as the main component, or the B-rich phase having a higher concentration of boron (B), the R—O—C—N concentrated part having higher concentrations of R, O, C and N than those in the main phase grains or the like may be also contained.

The content of R in the R-T-B based sintered magnet of the present embodiment is 25 mass % or more and 35 mass % or less, and preferably 29 mass % or more and 34 mass % or less. When the content of R is lower than 25 mass %, the generation of the R-T-B based compound which constitutes the main phase of the R-T-B based sintered magnet is insufficient. Thus, soft magnetic materials such as a-Fe may be deposited and the magnetic properties may deteriorate. Further, in the present embodiment, from the viewpoints of cost reduction and avoidance of resource shortage, the content of the heavy rare earth element contained as R is 1.0 mass % or less.

The content of B in the R-T-B based sintered magnet of present embodiment is 0.5 mass % or more and 1.5 mass % or less. The coercivity HcJ tends to decrease if the content of B is less than 0.5 mass % while the residual magnetic flux density Br tends to decrease when the content of B is more than 1.5 mass %. It is preferable that the content of B is 0.75 mass % or more and 0.95 mass % or less. Particularly, when the content of B ranges from 0.75 mass % to 0.95 mass %, it will be easier to form the R—Ga—C concentrated part.

As described above, T represents one or more iron family elements including Fe or the combination of Fe and Co. When Co is contained as T, the content of Co is preferably 0.3 mass % or more and 4.0 mass % or less, and more preferably 0.5 mass % or more and 1.5 mass % or less. If the content of Co exceeds 4 mass %, the residual magnetic flux density tends to decrease. Also, the R-T-B based sintered magnet of the present embodiment tends to be expensive. On the other hand, if the content of Co is less than 0.3 mass %, the corrosion resistance tends to deteriorate. Further, the content of Fe in the R-T-B based sintered magnet according to the present embodiment substantially accounts for the rest of the R-T-B based sintered magnet.

The R-T-B based sintered magnet of the present embodiment preferably contains Cu, and the content of Cu is preferably 0.05 to 1.5 mass % and more preferably 0.15 to 0.6 mass %. With the inclusion of Cu, the obtained magnet will have a high coercivity and a high corrosion resistance and also have its temperature properties improved. In addition, if the content of Cu exceeds 1.5 mass %, the residual magnetic flux density tends to decrease. On the other hand, if the content of Cu is less than 0.05 mass %, the coercivity tends to decrease.

The R-T-B based sintered magnet of the present embodiment contains Ga, and the content of Ga is preferably 0.05 to 1.5 mass % and more preferably 0.15 to 1.0 mass %. With the inclusion of Ga, the obtained magnet will have a high coercivity and a high corrosion resistance and also have its temperature properties improved. In addition, if the content of Ga exceeds 1.5 mass %, the residual magnetic flux density tends to decrease. On the other hand, if the content of Ga is less than 0.05 mass %, it will be hard to form the R—Ga—C concentrated part and the magnetic properties tend to deteriorate.

In the R-T-B based sintered magnet of the present embodiment, Al is preferably contained. With Al, the obtained magnet will have a high coercivity and a high corrosion resistance and also have its temperature properties improved. The content of Al is preferably 0.03 mass % or more and 0.6 mass % or less, and more preferably 0.10 mass % or more and 0.4 mass % or less.

Preferably, the R-T-B based sintered magnet of the present embodiment contains Zr. With Zr, effects will be produced that the grain growth is prevented during sintering and part of the carbon which is in an excessive amount is fixed as the ZrC phase. The content of Zr is preferably 0.2 mass % or more and 1.5 mass % or less.

In the present embodiment, the R-T-B based sintered magnet may also contain additive elements other than those mentioned above. In particular, Ti, V, Cr, Mn, Ni, Nb, Mo, Hf, Ta, W, Si, Bi, Sn and the like can be listed.

In the present embodiment, a certain amount of oxygen (O) can be contained in the R-T-B based sintered magnet. Said certain amount varies depending on other parameters and can be suitably determined. The content of oxygen is preferably 0.05 mass % or more from the viewpoint of corrosion resistance and is preferably to be 0.2 mass % or less from the viewpoint of magnetic properties.

In the R-T-B based sintered magnet of the present embodiment, carbon (C) is contained in an amount of 0.1 mass % to 0.3 mass %. The R-T-B based sintered magnet can be easily formed by containing 0.1 mass % or more of carbon in the R-T-B based sintered magnet. In the case of a conventional R-T-B based sintered magnet, if carbon is contained in such an amount, the coercivity tends to decrease. However, in the R-T-B based sintered magnet of the present embodiment, as the R—Ga—C concentrated part is formed, no reduction in coercivity has been found. On the other hand, if the carbon content is higher than 0.3 mass %, the coercivity tends to decrease even if the R—Ga—C concentrated part is formed.

In addition, a certain amount of nitrogen (N) can be contained in the R-T-B based sintered magnet in the present embodiment. Said certain amount varies depending on other parameters and can be suitably determined. The content of nitrogen is preferably 0.01 to 0.2 mass % from the viewpoint of magnetic properties.

Well known methods usually used can be employed as the methods for measuring the oxygen content, carbon content and the nitrogen content in the R-T-B based sintered magnet. For example, the oxygen content may be measured by an inert gas fusion-non-dispersive infrared absorption method, and the carbon content can be measured by a combustion in an oxygen airflow-infrared absorption method. In addition, the nitrogen content can be measured by an inert gas fusion-thermal conductivity method.

The R-T-B based sintered magnet of the present embodiment has the R—Ga—C concentrated part in the grain boundary, wherein the R—Ga—C concentrated part has higher concentrations of R, Ga and C than the main phase grains. In addition, as described above, the R—Ga—C concentrated part mainly consists of R, Ga and C, but components other than these ones can also be contained. As the element contained in the R—Ga—C concentrated part, for example, Cu, Co, Fe and the like can be presented.

As described above, with the formation of the R—Ga—C concentrated part in the grain boundary, the coercivity is found to be high even if the content of carbon is as high as 0.1 mass % to 0.3 mass %. In the conventional R-T-B based sintered magnet, if carbon is contained in such a high amount, most of carbon reacts with the R-rich phase in the grain boundary to form carbides. The R-T-B based sintered magnet is a sintered magnet obtained by liquid phase sintering, in which sintering is progressed by turning the R-rich phase into a liquid phase. During the sintering process, carbides will not turn into a liquid phase. Thus, the formation of carbides reduces the amount of the R-rich phases for that and results in the decrease of the coercivity. Particularly, when the average grain size of the main phase grains is small, the specific surface area of the main phase grains becomes larger, and the liquid phase needs to be in a large amount so that a sufficient coercivity will be exhibited. Thus, with increased carbon content, the coercivity tends to decrease easily. In contrast, in the case of the R-T-B based sintered magnet of the present embodiment, the R—Ga—C concentrated part formed in the grain boundary is a phase containing carbon and promotes the generation of the liquid phase during sintering. Thus, even if the carbon content is high, the liquid phase will still present in a sufficient amount during the sintering and further a high coercivity can be provided.

The R-T-B based sintered magnet in the present embodiment can be manufactured, for example, as described later, by the following method. In particular, in addition to the R-T-B based raw material alloy (a first alloy) mainly forming the main phase, a second alloy mainly forming the grain boundary can be added. Further, manufacture conditions in the manufacture steps such as the heat pattern in the sintering step can be controlled.

It is considered that the R—Ga—C concentrated part formed in the grain boundary of the R-T-B based sintered magnet of the present embodiment is formed as follows. In particular, R and Ga present in the second alloy form a compound with carbon from the carbon based compound mixed in the manufacture process after staying in a specified temperature region for a specified period of time in the sintering step. And the compound is deposited in the grain boundary as the R—Ga—C concentrated part. Then, the R—Ga—C concentrated part turns into the liquid phase at the sintering temperature to promote the sintering and then deposited again in the cooling process.

The R-T-B based sintered magnet of the present embodiment is usually used after being machined into any shape. The shape of the R-T-B based sintered magnet according to the present embodiment is not particularly restricted, and it may be a columnar shape such as a cuboid, a hexahedron, a tabular shape, a quadrangular prism and the like. Further, the shape can be a cylindrical shape with the cross-sectional shape of the R-T-B based sintered magnet being C-shaped. The quadrangular prism can be one with its bottom surface being a rectangle or one with the bottom surface being a square.

In addition, the R-T-B based sintered magnet of the present embodiment includes both a magnet product in which the present magnet has been magnetized after machining and a magnet product in which the present magnet has not been magnetized.

<Manufacturing Method of R-T-B Based Sintered Magnet>

Figure 2:
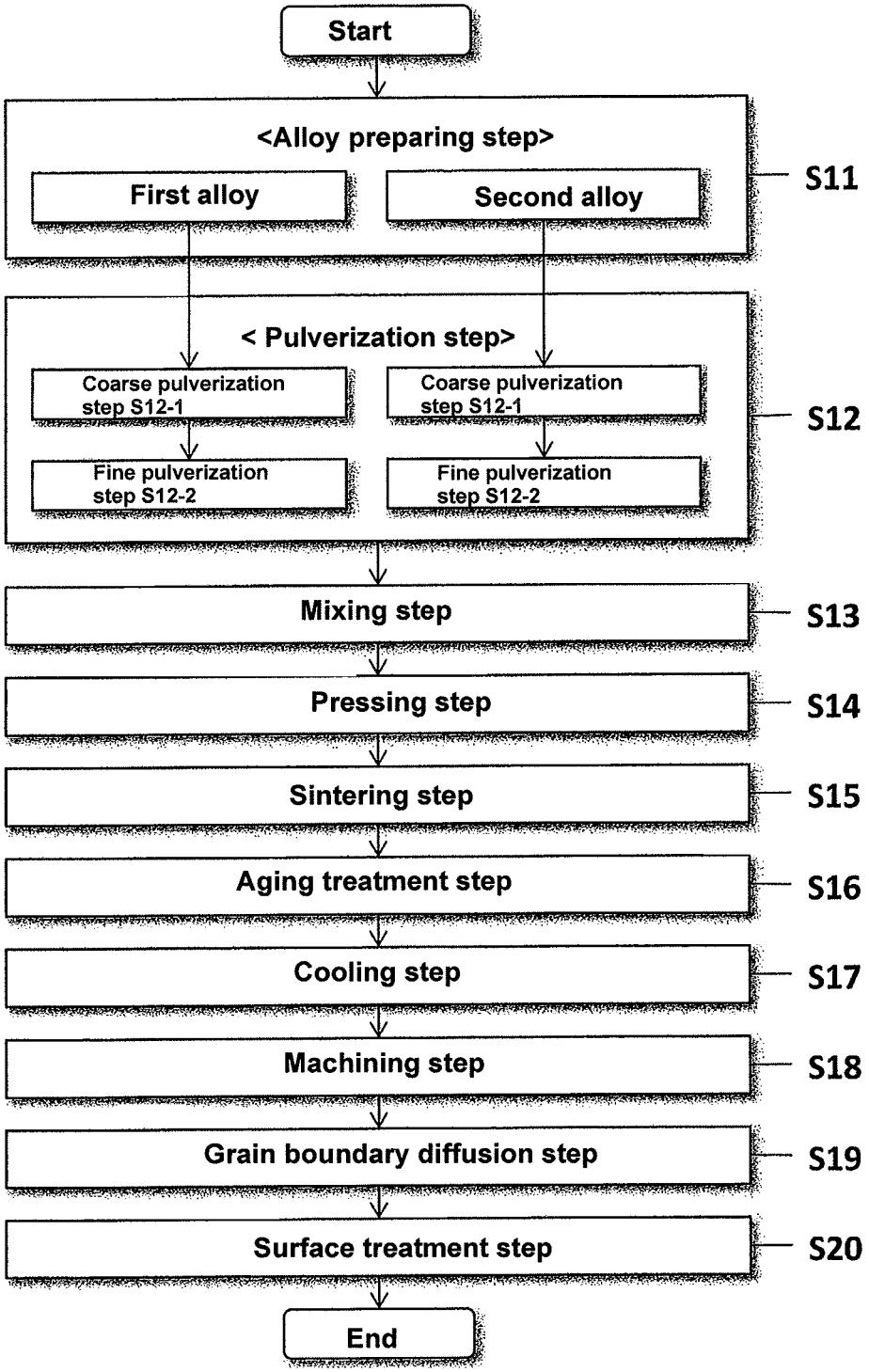
FIG. 2 is a flow chart showing an example of the method for manufacturing the R-T-B based sintered magnet of the present invention.

An example of the method for manufacturing the R-T-B based sintered magnet of the present embodiment with the configuration mentioned above will be descried with reference to the drawings. FIG. 2 is a flow chart showing an example of the manufacture method of the R-T-B based sintered magnet in the embodiment of the present invention. As shown in FIG. 2, the method for manufacturing the R-T-B based sintered magnet in the present embodiment contains the following steps.

(a) An alloy preparing step where a first alloy and a second alloy are prepared (Step S11);

(b) A pulverization step where the first alloy and the second alloy are pulverized (Step S12);

(c) A mixing step where the powder of the first alloy and the powder of the second alloy are mixed (Step S13);

(d) A pressing step where the mixed powder is pressed (Step S14);

(e) A sintering step where the green compact is sintered to provide an R-T-B based sintered magnet (Step S15);

(f) An aging treatment step where the R-T-B based sintered magnet is subjected to an aging treatment (Step S16);

(g) A cooling step where the R-T-B based sintered magnet is cooled (Step S17);

(h) A machining step where the R-T-B based sintered magnet is machined (Step 18);

(i) A grain boundary diffusion step where a heavy rare earth element is diffused in the grain boundary of the R-T-B based sintered magnet (Step 19);

(j) A surface treatment step where the R-T-B based sintered magnet is subjected to a surface treatment (Step 20).

[Alloy Preparing Step: Step S11]

An alloy of base mainly constituting the main phase (a first alloy) and an alloy of base constituting the grain boundary (a second alloy) of the R-T-B based sintered magnet of the present embodiment are prepared (an alloy preparing step (Step S11)). In this alloy preparing step (Step S11), the raw material metals corresponding to the composition of the R-T-B based sintered magnet according to the present embodiment are melted under vacuum or in an inert gas atmosphere such as Ar gas. Then, they are casted to provide the first alloy and the second alloy each having the desired composition. Further, in the present embodiment, a two-alloy method where the raw material powder is manufactured by mixing the two alloys (i.e., the first alloy and the second alloy) is described. However, a single-alloy method may also be used where a single alloy is used instead of the first alloy and the second alloy.

As the raw material metal, for instance, a rare earth metal, a rare earth alloy, a pure iron, ferro-boron, and further the alloy and compound thereof can be used. A casting method for casting the raw material metal can be, for example, an ingot casting method, a strip casting method, a book molding method, a centrifugal casting method or the like. In the case where segregation occurs, the obtained raw material alloy should be homogenized when required. The homogenization of the raw material alloy is performed by keeping it under vacuum or in an inert atmosphere at a temperature of 700° C. or more and 1500° C. or less for an hour or more. Thereby, the alloy for R-T-B based sintered magnet is melted and homogenized.

[Pulverization Step: Step S12]

After the first alloy and the second alloy are manufactured, the first alloy and the second alloy are pulverized (a pulverization step (Step S12)). In this pulverization step (Step S12), after the first alloy and the second alloy are manufactured, the first alloy and the second alloy are separately pulverized to make powders. Also, the first alloy and the second alloy may be pulverized together.

The pulverization step (Step S12) includes a coarse pulverization step (Step S12-1) where the alloy is pulverized to have a particle size of several hundreds of μm to several mm and a fine pulverization step (Step S12-2) where the alloy is pulverized to have a particle size of several μm.

(Coarse Pulverization Step (Step S12-1))

The first alloy and the second alloy are pulverized to provide a particle size of several hundreds of μm to several mm (a coarse pulverization step (Step S12-1)). In this way, the coarsely pulverized powders of the first alloy and the second alloy are thus obtained. The coarse pulverization can be performed as follows. First of all, the hydrogen is stored to the first alloy and the second alloy. Then, the hydrogen is emitted based on the difference of hydrogen storage amount among different phases. And with the dehydrogenation, a self-collapsed-typed pulverization (a hydrogen storage pulverization) occurs.

In addition to the hydrogen storage pulverization mentioned above, the coarse pulverization step (Step S12-1) can be performed by using a coarse pulverizer such as a stamp mill, a jaw crusher, a brown mill and the like in an inert atmosphere.

Further, in order to provide good magnetic properties, the atmosphere in each step, from the pulverization step (Step S12) to the sintering step (Step S15), is preferable with a low concentration of oxygen. The concentration of oxygen can be adjusted by controlling the atmosphere in each manufacturing step. In case the concentration of oxygen is high in each manufacturing step, the rare earth element in the powders of the first alloy and the second alloy is oxidized to generate oxides of R. The oxide of R will be deposited in the grain boundary without being reduced in the sintering process, resulting in decrease of Br in the obtained R-T-B based sintered magnet. Thus, the oxygen concentration in each step is preferably, for example, 100 ppm or less.

(Fine Pulverization Step: Step S12-2)

After the first alloy and the second alloy are coarsely pulverized, the coarsely pulverized powders of the first alloy and the second alloy are finely pulverized to provide an average particle size of approximately several μm (a fine pulverization step (Step S12-2)). In this way, finely pulverized powders of the first alloy and the second alloy are then obtained. A finely pulverized powder having particles of preferably 0.1 μm or more and 4.0 μm or less and more preferably 1.5 μm or more and 3.3 μm or less can be obtained by further finely pulverizing the coarsely pulverized powder. When the average particle size of the finely pulverized powder is controlled at such a range, the average gain size can be approximately 4.0 μm or less in the sintered main phase grains.

Further, although the finely pulverized powder is obtained by separately pulverizing the first alloy and the second alloy in the present embodiment, the fine pulverized powder may also be obtained after mixing the coarsely pulverized powder of the first alloy and that of the second alloy in the fine pulverization step (Step S12-2).

The fine pulverization step is performed by suitably adjusting conditions such as the pulverization time and the like and at the same time performing further pulverization to the coarsely pulverized powder using a fine pulverizer such as a jet mill, a ball mill and the like. The jet mill performs the following pulverization method. The jet mill discharges an inert gas (e.g. $N_2$ gas) at a high pressure from a narrow nozzle to produce a highly speeded gas flow. The coarsely pulverized powders of the first alloy and the second alloy are accelerated by this highly speeded gas flow, causing a collision among the coarsely pulverized powders of the first alloy and the second alloy or a collision between the coarsely pulverized powder and a target or the wall of a container.

Particularly, when a finely pulverized powder with a small particle size is obtained by using a jet mill, the pulverized powder has a very high activity on the surface. In this respect, the pulverized powder is likely to re-aggregate or attach to the wall of a container, and thus the yield tends to decrease. Therefore, by adding a pulverization aid such as zinc stearate, oleic amide and the like during the fine pulverization of the coarsely pulverized powders of the first alloy and the second alloy, the powder can be prevented from re-aggregating or attaching to the wall of a container. In this way, the finely pulverized powder can be obtained in a high yield. In addition, with the addition of such a pulverization aid, a finely pulverized powder that can be oriented easily during the pressing step can be obtained. The amount of the pulverization aid to be added varies depending on the particle size of the finely pulverized powder or the type of the pulverization aid to add but is preferably approximately 0.1 mass % to 1 mass %.

[Mixing Step: Step S13]

After the fine pulverization of the first alloy and the second alloy, the finely pulverized powders are mixed in an atmosphere with a low concentration of oxygen (a mixing step (Step S13)). A mixed powder is obtained thereby. The atmosphere with a low concentration of oxygen is an inert atmosphere such as $N_2$ gas, Ar gas and the like. The compounding ratio by mass of the first alloy powder to the second alloy powder is preferably 80 to 20 or more and 97 to 3 or less, and more preferably 90 to 10 or more and 97 to 3 or less.

Further, the compounding ratio of the first alloy to the second alloy when they are pulverized together in the pulverization step (Step S12) is the same as that in the case where they are pulverized separately. The compounding ratio by mass of the first alloy powder to the second alloy powder is preferably 80 to 20 or more and 97 to 3 or less, and more preferably 90 to 10 or more and 97 to 3 or less.

In the present embodiment, the first alloy and the second alloy preferably have different compositions. For instance, the second alloy contains more Ga, Cu and Co compared to the first alloy.

The content of Ga in the second alloy is preferably 0.2% to 20% by mass, and more preferably 0.5% to 10% by mass. The first alloy may or may not contain Ga. When the first alloy also contains Ga, the content of Ga in the first alloy is preferably 0.2% or less by mass.

In order to improve the orientation during the pressing step, a lubricant can be further added in the mixing step.

[Pressing Step: Step S14]

After the first alloy powder is mixed with the second alloy powder, the mixed powder is pressed to have a target shape (a pressing step (Step S14)). In the pressing step (Step S14), the mixed powder of the first alloy powder and the second alloy powder is filled in a press mold surrounded by an electromagnet, and then a pressure is applied thereto. In this way, the mixed powder is pressed into an arbitrary shape. At that time, a magnetic field is applied, and a predetermined orientation is produced in the raw material powder by the applied magnetic field. Then, the raw material powder is pressed with the crystal axis oriented in a certain direction under the magnetic field. Thus, a green compact is obtained. As the resultant green compact is oriented in a specified direction, an anisotropic R-T-B based sintered magnet with stronger magnetism can be provided.

The pressure provided during the pressing step is preferably 30 MPa to 300 MPa. The applied magnetic field is preferably 950 kA/m to 1600 kA/m in intensity. The applied magnetic field is not limited to a magnetostatic field, and it can also be a pulsed magnetic field. In addition, a magnetostatic field and a pulsed magnetic field can be used in combination.

Further, in addition to the dry pressing method as described above where the mixed powder is pressed directly, the pressing method can also be a wet pressing where a slurry obtained by dispersing the raw material powder in a solvent such as an oil is pressed.

The shape of the green compact obtained by pressing the mixed powder is not particularly restricted and can be an arbitrary shape such as a cuboid, a tabular shape, a columnar shape, a ring shape and the like in accordance with the desired shape to be obtained for the R-T-B based sintered magnet.

[Sintering Step: Step S15]

The green compact pressed in the magnetic field with a target shape is sintered under vacuum or in an inert atmosphere so as to provide an R-T-B based sintered magnet (a sintering step (Step S15)). The green compact is sintered by performing a thermal treatment under vacuum or in an inert atmosphere at 900° C. or more and 1200° C. or less for an hour or more and 30 hours or less. Thereby, a liquid phase sintering occurs in the mixed powder, and then an R-T-B based sintered magnet (a sintered body of R-T-B based sintered magnet) is obtained with an increased volume ratio occupied by the main phase. In order to provide an average grain size of the main phase grains of 4 μm or less, the sintering temperature and the sintering time need to be adjusted depending on various conditions such as the composition, the pulverization method, the particle size and the distribution of particle size.

For the formation of the R—Ga—C concentrated part, it is preferable that a step is added in the sintering step. In this added step, the green compact is left still at a specific temperature segment before the temperature rises to the sintering temperature. The specific temperature in the additive step is preferably 500 to 700° C. And the green compact is kept at this specific temperature for preferably 30 minutes to 3 hours. It is considered that if such a step with such conditions is added in the temperature rising process, the R—Ga—C concentrated part will be formed with the following underlying mechanism.

(1) Certain organic compounds are present in the green compact such as the pulverization aid added in the pulverization step, the lubricant added in the mixing step or the remaining components from the solvent used in the wetting pressing. These compounds are not completely thermal decomposed and remain as carbon based components.

(2) The finely pulverized powder from the second alloy containing R and Ga produces hydrides at a stage prior to the sintering step through the hydrogen storage treatment in the coarse pulverization step. In the step where the green compact is kept at a certain temperature, hydrogen will leave. As the second alloy containing Ga has a lower melting point than the first alloy, a liquid phase is generated when hydrogen leaves.

(3) With the generation of a liquid phase from the second alloy, reactions occur preferably between the carbon based components mentioned in (1) and the components of the second alloy containing R and Ga, resulting the deposition of the R—Ga—C concentrated part in the grain boundary.

After the green compact is sintered, the sintered body is preferably rapidly cooled from the viewpoint of productivity increase.

[Aging Treatment Step: Step S16]

After the green compact is sintered, the R-T-B based sintered magnet is subjected to an aging treatment (an aging treatment step (Step S16)). After the sintering step, an aging treatment is provided to the R-T-B based sintered magnet by keeping the R-T-B based sintered magnet at a temperature lower than that during sintering. The aging treatment can be, for example, either done in two stages or in one single stage. In the two-stage heating treatment, the R-T-B based sintered magnet is heated at 700° C. or more and 900° C. or less for 1 hour to 3 hours and then further heated at 500° C. to 700° C. for 1 hour to 3 hours. In the single-stage heating treatment, the R-T-B based sintered magnet is heated at around 600° C. for 1 hour to 3 hours. The treatment conditions can be suitably adjusted based on the number of times the aging treatment to be done. With such an aging treatment, the magnetic properties of the R-T-B based sintered magnet can be improved. In addition, the aging treatment step (Step S16) can be performed after a machining step (Step S18) or a grain boundary diffusion step (Step S19).

[Cooling Step: Step S17]

After an aging treatment is provided to the R-T-B based sintered magnet, the R-T-B based sintered magnet is rapidly cooled in an Ar atmosphere (a cooling step (Step S17)). In this way, the R-T-B based sintered magnet according to the present embodiment is obtained. The cooling rate is not particularly restricted, and it is preferably 30° C./min or higher.

[Machining Step: Step S18]

The obtained R-T-B based sintered magnet may be machined to have a desired shape if required (a machining step: Step S18). The machining method can be, for example, a shaping process such as cutting, grinding and the like, and a chamfering process such as barrel polishing and the like.

[Grain Boundary Diffusion Step: Step S19]

A step where the heavy rare earth element is further diffused in a grain boundary of the machined R-T-B based sintered magnet may be performed (a grain boundary diffusion step: Step S19). The grain boundary diffusion may be performed by attaching a compound containing the heavy rare earth element to the surface of R-T-B based sintered magnet through coating, evaporating or the like followed by a thermal treatment, or alternatively by providing a thermal treatment to the R-T-B based sintered magnet in an atmosphere containing the vapor of the heavy rare earth element. With this step, the coercivity of the R-T-B based sintered magnet can be further improved.

[Surface Treatment Step: Step S20]

A surface treatment such as plating, resin coating, oxidization treatment, chemical conversion treatment and the like can be provided to the R-T-B based sintered magnet obtained from the steps above (a surface treatment step (Step S20)). Thus, the corrosion resistance can be further improved.

In addition, although the machining step (Step S18), the grain boundary diffusion step (Step S19) and the surface treatment step (Step S20) are performed in the present embodiment, these steps are not necessary to be performed.

The R-T-B based sintered magnet according to the present embodiment is manufactured as mentioned above, and the treatment ends. In addition, a magnet product can be obtained by magnetizing the obtained magnet.

In thus obtained R-T-B based sintered magnet according to the present embodiment, as the R—Ga—C concentrated part is contained in the grain boundary, good magnetic properties will be provided even if the content of carbon is high.

The R-T-B based sintered magnet of the present embodiment can be suitably used as a magnet in, for example, a surface permanent magnet (SPM) typed rotating machine with an magnet attached on the surface of a rotor, an interior permanent magnet (IPM) typed rotating machine such as an inner rotor typed brushless motor, a PRM (permanent magnet reluctance motor) or the like. In particular, the R-T-B based sintered magnet of the present embodiment is applicable to a spindle motor for rotational motion of a hard disk or a voice coil motor in a hard disk drive, a motor for an electric vehicle or a hybrid electric car, a motor for an electrically powered steering device in an automobile, a servo motor for a machine tool, a motor for a vibrator in a cellular phone, a motor for a printer, a motor for a generator and the like.

The present invention will not be limited to the embodiment above, and various modifications are available within the scope of the present invention.

EXAMPLES

Hereinafter, the present invention will be described in more details based on the examples. However, the present invention will not be limited to the following examples.

Examples 1 to 4

First of all, raw material alloys were prepared by a strip casting method so as to provide sintered magnets with Magnet compositions A to D as shown in Table 1. A first alloy mainly forming the main phase of the magnet and the second alloy mainly forming the grain boundary both with the compositions as shown in Table 1 were respectively prepared as the raw material alloys. In addition, in Table 1, the term bal. refers to the rest of the each alloy when the whole composition was defined as 100 mass %, and (T.RE) refers to the mass percentage occupied by the rare earth elements in total.

TABLE 1

| | | Composition (mass %) | | | | | | | | | Mass | Corresponding | Corresponding to Comparative |
|---|---|---|---|---|---|---|---|---|---|---|---|---|---|
| | | Nd | Pr | Dy | (T. RE) | Ga | Al | Zr | B | Fe | ratio | to Examples | Examples |
| Composition A | First alloy | 20.00 | 10.50 | 0.00 | 30.50 | 0.00 | 0.10 | 0.60 | 0.94 | bal. | 95 | Example 1 | Comparative |
| | Second alloy | 33.00 | 17.00 | 0.00 | 50.00 | 6.00 | 0.00 | 0.00 | 0.00 | bal. | 5 | | Example 1 |
| | Target composition of Sintered body | 20.65 | 10.83 | 0.00 | 31.48 | 0.30 | 0.10 | 0.57 | 0.89 | bal. | | | and 5 to 8 |
| Composition B | First alloy | 15.50 | 15.00 | 0.00 | 30.50 | 0.00 | 0.40 | 1.67 | 0.90 | bal. | 90 | Example 2 | Comparative |
| | Second alloy | 25.00 | 25.00 | 0.00 | 50.00 | 6.00 | 0.00 | 0.00 | 0.00 | bal. | 10 | | Example 2 |
| | Target composition of Sintered body | 16.45 | 16.00 | 0.00 | 32.45 | 0.60 | 0.36 | 1.50 | 0.81 | bal. | | | |
| Composition C | First alloy | 30.50 | 0.00 | 0.00 | 30.50 | 0.00 | 0.50 | 0.90 | 0.92 | bal. | 93 | Example 3 | Comparative |
| | Second alloy | 50.00 | 0.00 | 0.00 | 50.00 | 6.00 | 0.00 | 0.00 | 0.00 | bal. | 7 | | Example 3 |
| | Target composition of Sintered body | 31.87 | 0.00 | 0.00 | 31.87 | 0.42 | 0.47 | 0.84 | 0.86 | bal. | | | |
| Composition D | First alloy | 30.00 | 0.00 | 0.50 | 30.50 | 0.00 | 0.20 | 0.31 | 0.98 | bal. | 97 | Example 4 | Comparative |
| | Second alloy | 50.00 | 0.00 | 0.00 | 50.00 | 6.00 | 0.00 | 0.00 | 0.00 | bal. | 3 | | Example 4 |
| | Target composition of Sintered body | 30.60 | 0.00 | 0.49 | 31.09 | 0.18 | 0.19 | 0.30 | 0.95 | bal. | | | |

Next, the hydrogen storage pulverization (i.e., the coarse pulverization) was done. In particular, after hydrogen is stored to the raw material alloy at room temperature, dehydrogenation was done at 400° C. for 1 hour in an Ar atmosphere.

In the present Examples, each step, from the hydrogen storage pulverization to the sintering step (i.e., the fine pulverization and the pressing step), was done in an Ar atmosphere with the oxygen concentration therein being lower than 50 ppm (the same conditions were applied to the following Examples and Comparative Examples).

Next, after the hydrogen storage pulverization but before the fine pulverization, oleic amide was added as a pulverization aid in the coarsely pulverized powder of each alloy in an amount of 0.4 mass %. The resultant mixture was mixed by a Nauta mixer. And then, a jet mill was used to perform the fine pulverization. During the fine pulverization, the particle size of the finely pulverized powder was adjusted by changing the classification conditions in the jet mill. The particle size obtained after pulverization in each Example was shown in Table 2.

TABLE 2

| | Composition | Particle size after pulverization (μm) | Keeping step at 600° C. | Carbon content (mass %) | Average grain size of main phase grains (μm) | R—Ga—C concentrated part | Magnetic properties Br (mT) | Magnetic properties HcJ (kA/m) | HcJ difference with Comparative Example (kA/m) |
|---|---|---|---|---|---|---|---|---|---|
| Example 1 | Composition A | 2.8 | Performed | 0.16 | 3.4 | Present | 1372 | 1602 | 35 |
| Comparative Example 1 | | 2.8 | None | 0.16 | 3.4 | None | 1375 | 1567 | |
| Example 2 | Composition B | 1.6 | Performed | 0.30 | 1.9 | Present | 1352 | 1712 | 51 |
| Comparative Example 2 | | 1.6 | None | 0.30 | 1.9 | None | 1348 | 1661 | |
| Example 3 | Composition C | 2.2 | Performed | 0.21 | 2.8 | Present | 1362 | 1646 | 59 |
| Comparative Example 3 | | 2.2 | None | 0.21 | 2.8 | None | 1364 | 1587 | |
| Example 4 | Composition D | 3.3 | Performed | 0.10 | 4.0 | Present | 1381 | 1542 | 26 |
| Comparative Example 4 | | 3.3 | None | 0.10 | 4.0 | None | 1383 | 1516 | |
| Comparative Example 5 | Composition A | 4.5 | Performed | 0.07 | 5.3 | None | 1325 | 1387 | −3 |
| Comparative Example 6 | | 4.5 | None | 0.07 | 5.3 | None | 1326 | 1390 | |
| Comparative Example 7 | Composition A + | 2.8 | Performed | 0.35 | 3.5 | Present | 1412 | 1142 | 5 |
| Comparative Example 8 | carbon | 2.8 | None | 0.35 | 3.5 | None | 1413 | 1137 | |

Thereafter, the finely pulverized powder of the first alloy and the finely pulverized powder of the second alloy were mixed at the ratio as shown in Table 1 by using a Nauta mixer. In this way, a mixed power used as the raw material powder of the R-T-B based sintered magnet was prepared.

Subsequently, the obtained mixed powder was filled in a press mold arranged in an electromagnet, and the powder was pressed under an applied pressure of 120 MPa in a magnetic field of 1200 kA/m. In this way, a green compact was obtained.

After that, the green compact was sintered as follows. Particularly, during the sintering, the green compact was kept in an Ar atmosphere of 5 kPa, wherein the temperature was increased to 600° C. in a rising rate of 6° C./minute. Then, the green compact was left under vacuum at 600° C. for 2 hours. Subsequently, the temperature was further increased. The green compact was kept under vacuum at 1030° C. for 12 hours. Then, the temperature was rapidly cooled so that a sintered body (the R-T-B based sintered magnet) was obtained. Next, a two-stage aging treatment was performed to the obtained sintered body at 850° C. for 1 hour and then at 500° C. for 1 hour (both in an Ar atmosphere). In this respect, the R-T-B based sintered magnets of Examples 1 to 4 were obtained.

Comparative Examples 1 to 4

In Comparative Examples 1 to 4, R-T-B based sintered magnets were manufactured respectively corresponding to Examples 1 to 4 except that the step of keeping the green compact at 600° C. for 2 hours wasn't added during the sintering.

Comparative Examples 5 to 6

An R-T-B based sintered magnet of Comparative Example 5 was similarly manufactured as in Example 1 except that alloys with Composition A as shown in Table 1 were used and the particle size after pulverization was 4.5 μm or less. An R-T-B based sintered magnet of Comparative Example 6 was manufactured as in Example 5 except that the step of keeping the green compact at 600° C. for 2 hours wasn't added during the sintering.

Comparative Examples 7 to 8

An R-T-B based sintered magnet of Comparative Example 7 was manufactured as in Example 1 except that granular carbon black was further added in an amount of 0.2 mass % in the mixing step for mixing the first alloy and the second alloy. In addition, an R-T-B based sintered magnet of Comparative Example 8 was manufactured as in Comparative Example 7 except that the step of keeping the green compact at 600° C. for 2 hours wasn't added during the sintering.

<Evaluation>

[Evaluation on Structure]

For the R-T-B based sintered magnet obtained in Examples 1 to 4 and Comparative Examples 1 to 8, the surface of a cross-section was milled by ion milling to eliminate the influence caused by, for example, the oxidation on the outermost surface. Then, the element distribution in the cross-section of the R-T-B based sintered magnet was observed and then analyzed through EPMA (Electron Probe Micro Analyzer). In particular, each element including Nd, Ga, and C was mapping analyzed in an area of 50 μm×50 μm, and the part where the distribution concentration of each element including Nd, Ga, and C was higher than that in the main phase grains was then observed.

As a result, it was confirmed in the R-T-B based sintered magnet from Examples 1 to 4 and Comparative Example 7 that the part where the distribution concentration of each element including Nd, Ga, and C was higher than that in the main phase grains (the R—Ga—C concentrated part) existed in the grain boundary. However, no R—Ga—C concentrated part was found in the grain boundary of the R-T-B based sintered magnet from Comparative Examples 1 to 6 and Comparative Example 8.

Further, in the R-T-B based sintered magnet from Examples 1 to 4 where the R—Ga—C concentrated part was observed in the grain boundary, the R—Ga—C concentrated part (5 points) and the crystal grain of the main phase (1 point) were respectively subjected to a quantitative analysis by EPMA. The result from Example 1 was representatively shown in Table 3.

Further, the compositional ratio listed in this table referred to the ratio of each element when the total atom number of Nd, Pr, Dy, Fe, Ga and C was defined as 100. In particular, the calculated compositional ratio of C was affected by the background in the EPMA measurement and thus tended to be higher than the real value. However, the relationship among values was not affected.

TABLE 3

| | | Compositional ratio (%) | | | |
|---|---|---|---|---|---|
| | | Nd + Pr + Dy | Fe | Ga | C |
| Example 1 | R—Ga—C concentrated part (5 points on average) | 50 | 15 | 14 | 21 |
| | Main phase | 12 | 76 | 0 | 12 |

As shown in Table 3, in the quantitative analysis using EPMA, it was also confirmed in Example 1 that the part where the distribution concentration of each element including R (Nd+Pr+Dy), Ga and C was higher than that in the main phase grains (the R—Ga—C concentrated part) existed in the grain boundary of the R-T-B based sintered magnet. Further, the R—Ga—C concentrated part with the similar composition was found in the R-T-B based sintered magnet from Examples 2 to 4.

[Compositional Analysis]

The R-T-B based sintered magnets obtained in Examples 1 to 4 and Comparative Examples 1 to 8 were subjected to a compositional analysis through an X-ray fluorescence analysis together with an Inductively Coupled Plasma-Mass Spectrometry (ICP-MS). As a result, it was confirmed that the composition of any one of the R-T-B based sintered magnets was almost the same with the composition of the added raw materials (the target composition of the sintered body as shown in Table 1). In addition, the carbon content was measured by a combustion in an oxygen airflow-infrared absorption method. The results concerning the carbon content were collectively shown in Table 2.

[Evaluation on Grain Size]

In the R-T-B based sintered magnets from Examples 1 to 4 and Comparative Examples 1 to 8, the average grain size of the main phase grains was evaluated. With respect to the average grain size of the main phase grains, the cross-section of a sample was ground and then observed under an optical microscope, and incorporated into image analysis software so as to determine the distribution of grain size. The average grain size of the main phase grains was collectively shown in Table 2.

[Magnetic Properties]

The magnetic properties of the R-T-B based sintered magnet from Examples 1 to 4 and Comparative Examples 1 to 8 were determined by using a B—H tracer. The residual magnetic flux density Br and the coercivity HcJ were measured as the magnetic properties. The results were collectively shown in Table 2.

As shown in Table 2, the R-T-B based sintered magnets from Examples 1 to 4 had the same composition with Comparative Examples 1 to 4 respectively, and the coercivity of the R-T-B based sintered magnets from Examples 1 to 4 was 20 kA/m or more higher than that of the R-T-B based sintered magnets from Comparative Examples 1 to 4. In other words, the R-T-B based sintered magnets from Examples had a higher coercivity. Further, in the R-T-B based sintered magnet from Comparative Examples 5 and 6 where the carbon content was lower than 0.1 mass %, R—Ga—C concentrated part wasn't found and high coercivity wasn't obtained even if the step of keeping the green compact at 600° C. for 2 hours was added during the sintering. Further, in the R-T-B based sintered magnet from Comparative Examples 7 and 8 where the carbon content was higher than 0.3 mass %, sufficient coercivity can't be obtained due to remarkably high carbon content.

Examples 5 to 8

In Examples 5 to 8, R-T-B based sintered magnets were manufactured as in Examples 1 to 4 except that raw material alloys were prepared by a strip casting method to provide the sintered magnets having Compositions E to H as shown in Table 4 and further the particle size of the finely pulverized powder was equal to the values as shown in Table 5. Examples 5 and 6 are examples containing Cu as the composition of the sintered magnet, and Examples 7 and 8 are the examples containing Cu and Co as the composition of the sintered magnet.

TABLE 4

| | | Composition (mass %) | | | | | | | | | | | | | Corresponding |
|---|---|---|---|---|---|---|---|---|---|---|---|---|---|---|---|
| | | Nd | Pr | Dy | (T. RE) | Ga | Al | Cu | Co | Zr | B | Fe | Mass ratio | Corresponding to Examples | to Comparative Examples |
| Composition E | First alloy | 24.00 | 7.50 | 0.00 | 31.50 | 0.53 | 0.10 | 0.00 | 0.00 | 1.00 | 0.79 | bal. | 95 | Example 5 | Comparative Example 9 |
| | Second alloy | 38.00 | 12.00 | 0.00 | 50.00 | 10.00 | 0.00 | 12.00 | 0.00 | 0.00 | 0.00 | bal. | 5 | | |
| | Target composition of Sintered body | 24.70 | 7.73 | 0.00 | 32.43 | 1.00 | 0.10 | 0.60 | 0.00 | 0.95 | 0.75 | bal. | | | |
| Composition F | First alloy | 29.00 | 0.00 | 0.00 | 29.00 | 0.00 | 0.65 | 0.00 | 0.00 | 0.22 | 0.97 | bal. | 95 | Example 6 | Comparative Example 10 |
| | Second alloy | 50.00 | 0.00 | 0.00 | 50.00 | 4.00 | 0.00 | 6.00 | 0.00 | 0.00 | 0.00 | bal. | 5 | | |
| | Target composition of Sintered body | 30.05 | 0.00 | 0.00 | 30.05 | 0.20 | 0.62 | 0.30 | 0.00 | 0.21 | 0.92 | bal. | | | |
| Composition G | First alloy | 30.00 | 0.00 | 0.00 | 30.00 | 0.00 | 0.20 | 0.00 | 0.26 | 0.60 | 0.92 | bal. | 95 | Example 7 | Comparative Example 11 |
| | Second alloy | 50.00 | 0.00 | 0.00 | 50.00 | 10.00 | 0.00 | 3.00 | 5.00 | 0.00 | 0.00 | bal. | 5 | | |
| | Target composition of Sintered body | 31.00 | 0.00 | 0.00 | 31.00 | 0.50 | 0.19 | 0.15 | 0.50 | 0.57 | 0.87 | bal. | | | |
| Composition H | First alloy | 31.00 | 0.00 | 0.00 | 31.00 | 0.00 | 0.20 | 0.00 | 0.50 | 0.40 | 0.88 | bal. | 95 | Example 8 | Comparative Example 12 |
| | Second alloy | 30.00 | 0.00 | 20.00 | 50.00 | 12.00 | 0.00 | 5.00 | 20.00 | 0.00 | 0.00 | bal. | 5 | | |
| | Target composition of Sintered body | 30.95 | 0.00 | 1.00 | 31.95 | 0.60 | 0.19 | 0.25 | 1.48 | 0.38 | 0.84 | bal. | | | |

TABLE 5

| | Composition | Particle size after pulverization (μm) | Keeping step at 600° C. | Carbon content (mass %) | Average grain size of main phase grains (μm) | R—Ga—C concentrated part | Magnetic properties Br (mT) | Magnetic properties HcJ (kA/m) | Hcj difference with Comparative Example (kA/m) |
|---|---|---|---|---|---|---|---|---|---|
| Example 5 | Composition E | 1.7 | Performed | 0.25 | 2.1 | Present | 1342 | 1795 | 89 |
| Comparative Example 9 | | 1.7 | None | 0.25 | 2.1 | None | 1344 | 1706 | |
| Example 6 | Composition F | 3.0 | Performed | 0.12 | 3.6 | Present | 1402 | 1452 | 94 |
| Comparative Example 10 | | 3.0 | None | 0.12 | 3.6 | None | 1407 | 1358 | |
| Example 7 | Composition G | 2.8 | Performed | 0.16 | 3.4 | Present | 1352 | 1656 | 114 |
| Comparative Example 11 | | 2.8 | None | 0.16 | 3.4 | None | 1355 | 1542 | |

TABLE 5-continued

| | Composition | Particle size after pulverization (μm) | Keeping step at 600° C. | Carbon content (mass %) | Average grain size of main phase grains (μm) | R—Ga—C concentrated part | Magnetic properties Br (mT) | Magnetic properties HcJ (kA/m) | Hcj difference with Comparative Example (kA/m) |
|---|---|---|---|---|---|---|---|---|---|
| Example 8 | Composition H | 2.5 | Performed | 0.18 | 3.0 | Present | 1324 | 1876 | 134 |
| Comparative Example 12 | | 2.5 | None | 0.18 | 3.0 | None | 1326 | 1742 | |

Comparative Examples 9 to 11

In Comparative Examples 9 to 11, R-T-B based sintered magnets were manufactured as in Examples 5 to 8 except that the step keeping the green compact at 600° C. for 2 hours wasn't added during the sintering.

<Evaluation>

The R-T-B based sintered magnets from Examples 5 to 8 and Comparative Examples 9 to 11 were similarly evaluated as in Examples 1 to 4 and Comparative Examples 1 to 8. The results from the compositional analysis confirmed that the composition of any one of the R-T-B based sintered magnets was almost the same with the composition of the added raw materials (the target composition of the sintered body as shown in Table 4). In addition, the carbon content and the average grain size of the main phase grains were shown in Table 5.

An evaluation on structure was similarly done as in Examples 1 to 4. As a result, it was confirmed in the R-T-B based sintered magnet from Examples 5 to 8 that a part where the concentration of each element including Nd, Ga and C was higher than that in the main phase grains existed in the grain boundary. However, no such R—Ga—C concentrated part was found in the grain boundary of the R-T-B based sintered magnet from Comparative Examples 9 to 12.

Further, in the R-T-B based sintered magnet from Examples 5 to 8 where the R—Ga—C concentrated part was observed in the grain boundary, the R—Ga—C concentrated part (5 points) and the main phase (1 point) were respectively subjected to a quantitative analysis by EPMA. The result from Examples 5 and 7 were representatively shown in Table 6.

Further, the compositional ratio listed in Table 6 referred to the ratio of each element when the total atom number of Nd, Pr, Dy, Fe, Ga, Cu and C was defined as 100. In particular, the calculated compositional ratio of C was affected by the background in the EPMA measurement and thus tended to be higher than the real value. However, the relationship among values was not affected.

TABLE 6

| | | Compositional ratio (%) Nd + Pr + Dy | Fe | Ga | Cu | Co | C |
|---|---|---|---|---|---|---|---|
| Example 5 | R—Ga—C concentrated part (5 points on average) | 51 | 15 | 10 | 4 | 0 | 19 |
| | Main phase | 12 | 77 | 1 | 0 | 0 | 10 |
| Example 7 | R—Ga—C concentrated part (5 points on average) | 48 | 11 | 11 | 4 | 4 | 22 |
| | Main phase | 12 | 74 | 0 | 1 | 1 | 12 |

As shown in Table 6, in the quantitative analysis using EPMA, it was also confirmed in Examples 5 and 7 that the part where the distribution concentration of each element including R (Nd+Pr+Dy), Ga and C was higher than that in the main phase grains (the R—Ga—C concentrated part) existed in the grain boundary of the R-T-B based sintered magnet. It was also confirmed in the Example 5 that the R—Ga—C concentrated part further contained Cu and the concentration of Cu was higher than that in the main phase grains. Further, it was confirmed in Example 5 that the R—Ga—C concentrated part contained Co and Cu, and the concentrations of Co and Cu were respectively higher than those in the main phase grains.

It was confirmed that the R—Ga—C concentrated part having the similar composition with that in Example 5 existed in the R-T-B based sintered magnet of Example 6, and the R—Ga—C concentrated part having the similar composition with that in Example 7 existed in the R-T-B based sintered magnet of Example 8.

The magnetic properties of the R-T-B based sintered magnet from Examples 5 to 8 and Comparative Examples 9 to 12 were determined by using a B—H tracer. The residual magnetic flux density Br and the coercivity HcJ were measured as the magnetic properties. The results were collectively shown in Table 5.

As shown in Table 5, the coercivity of the R-T-B based sintered magnet from Examples 5 to 8 was respectively higher than that of the R-T-B based sintered magnet from Comparative Examples 9 to 12, wherein the R-T-B based sintered magnet from Examples 5 to 8 had the same composition with Comparative Examples 9 to 12 respectively. Further, the improvement degree of HcJ in Examples 5 and 6 (with Cu contained in the R—Ga—C concentrated part) compared to Comparative Examples tended to be greater than that of HcJ in Examples 1 to 4 (without Cu) compared to Comparative Examples. Also, it was confirmed that the improvement degree of HcJ in Examples 7 and 8 (with Cu and Co contained in the R—Ga—C concentrated part) compared to Comparative Examples tended to be greater than that of HcJ in Examples 5 to 6 (without Co) compared to Comparative Examples.

DESCRIPTION OF REFERENCE NUMERALS

2 Main phase grain
4 Two-grain boundary part
6 Triple junction

What is claimed is:

1. An R-T-B based sintered magnet comprising:

an R-T-B based compound as main phase grains,

Ga in an amount of 0.42 mass % or more and 1.5 mass % or less, and

C in an amount in a range of from 0.21 mass % to 0.3 mass %, wherein

R represents at least one rare earth element,

T represents one or more elements comprising Fe or a combination of Fe and Co, an average grain size of the main phase grains is in a range of from 1.5 μm to 2.8 μm, an R—Ga—C concentrated part exists in a grain boundary formed between or among two or more adjacent main phase grains, concentrations of R, Ga, and C in the R—Ga—C concentrated part are higher than those in the main phase grains respectively, a content of R in the R-T-B based sintered magnet is 31.87 mass % or more and 32.45 mass % or less, a content of B in the R-T-B based sintered magnet is 0.75 mass % or more and 0.86 mass % or less, and a content of a heavy rare earth element contained as R in the R-T-B based sintered magnet is 1.0 mass % or less.

2. The R-T-B based sintered magnet of claim 1, wherein the R—Ga—C concentrated part further comprises Cu, and a concentration of Cu in the R—Ga—C concentrated part is higher than that in the main phase grains.

3. The R-T-B based sintered magnet of claim 2, wherein the R—Ga—C concentrated part further comprises Co, and a concentration of Co in the R—Ga—C concentrated part is higher than that in the main phase grains.

4. The R-T-B based sintered magnet of claim 1, wherein the R—Ga—C concentrated part further comprises Co, and a concentration of Co in the R—Ga—C concentrated part is higher than that in the main phase grains.

5. The R-T-B based sintered magnet of claim 1, wherein:

a content of Co in the R-T-B based sintered magnet is 0.3 mass % or more and 4.0 mass % or less.

6. A rotating machine comprising the R-T-B based sintered magnet of claim 1.

7. The R-T-B based sintered magnet of claim 1, further comprising Zr in an amount of 0.2 mass % or more and 1.5 mass % or less.

8. The R-T-B based sintered magnet of claim 1, wherein the R—Ga—C concentrated part is a single, continuous area within the grain boundary.

9. The R-T-B based sintered magnet of claim 8, wherein the grain boundary contains R—Ga—C concentrated parts.

10. The R-T-B based sintered magnet of claim 1, wherein the R—Ga—C concentrated part is formed in the grain boundary by the formation of a compound of R and Ga with C during manufacturing.

11. The R-T-B based sintered magnet of claim 1, wherein the R—Ga—C concentrated part is formed in the grain boundary by performing a heat treatment step in which a temperature is maintained in a range of from 500 to 700° C. for 30 minutes to 3 hours before raising the temperature to a sintering temperature.

12. The R-T-B based sintered magnet of claim 1, wherein the content of B in the R-T-B based sintered magnet is 0.75 mass % or more and 0.81 mass % or less.

13. An R-T-B based sintered magnet comprising:

an R-T-B based compound as main phase grains,

Ga in an amount of 0.42 mass % or more and 1.5 mass % or less, and

C in an amount in a range of from 0.21 mass % to 0.3 mass %, wherein

R represents at least one rare earth element,

T represents one or more elements comprising Fe or a combination of Fe and Co, an average grain size of the main phase grains is in a range of from 1.5 μm to 2.8 μm, an R—Ga—C concentrated part exists in a grain boundary formed between or among two or more adjacent main phase grains, concentrations of R, Ga, and C in the R—Ga—C concentrated part are higher than those in the main phase grains respectively, a content of B in the R-T-B based sintered magnet is 0.75 mass % or more and 0.81 mass % or less, and a content of a heavy rare earth element contained as R in the R-T-B based sintered magnet is 1.0 mass % or less.

* * * * *